United States Patent [19]

Bobo

[11] 4,155,160

[45] May 22, 1979

[54] CAN OPENER

[76] Inventor: Lawrence L. Bobo, 524 Rockey Branch, Coppell, Tex. 75019

[21] Appl. No.: 872,543

[22] Filed: Jan. 26, 1978

Related U.S. Application Data

[63] Continuation of Ser. No. 658,502, Feb. 17, 1976, abandoned.

[51] Int. Cl.[2] ..... B67B 7/30

[52] U.S. Cl. ..... 30/435

[58] Field of Search ..... 30/417, 418, 435, 436, 30/442

[56] References Cited

U.S. PATENT DOCUMENTS

| | | | |
|---|---|---|---|
| 1,102,962 | 7/1914 | Schönfeld | 30/435 |
| 1,524,996 | 2/1925 | Porrier | 30/441 |
| 1,945,137 | 1/1934 | Dahl | 30/418 |
| 2,556,766 | 6/1951 | Muthieu | 30/418 |
| 3,008,231 | 11/1961 | Caproni | 30/435 |

*Primary Examiner*—Gary L. Smith

*Attorney, Agent, or Firm*—Leo N. Heiting

[57] ABSTRACT

Disclosed is apparatus for removing the top of a metallic container such as an aluminum beverage container. The device, in removing the container top, leaves the bead around the top of the container intact. The severed edge remaining on the container is substantially burr free, thereby rendering the container suitable for use as a tumbler or other household container.

7 Claims, 6 Drawing Figures

Fig. 3
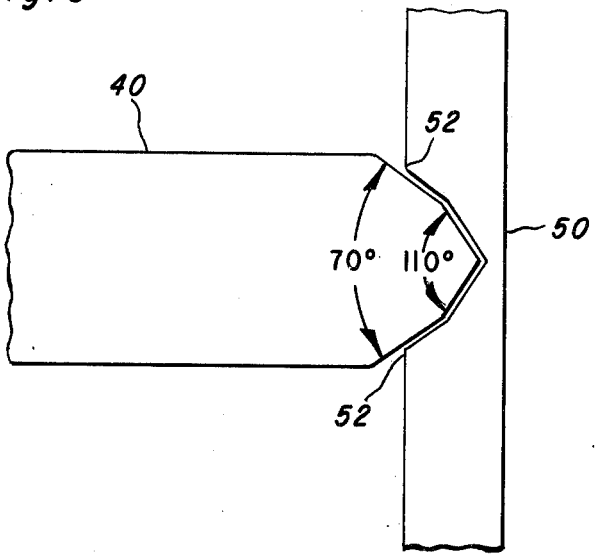
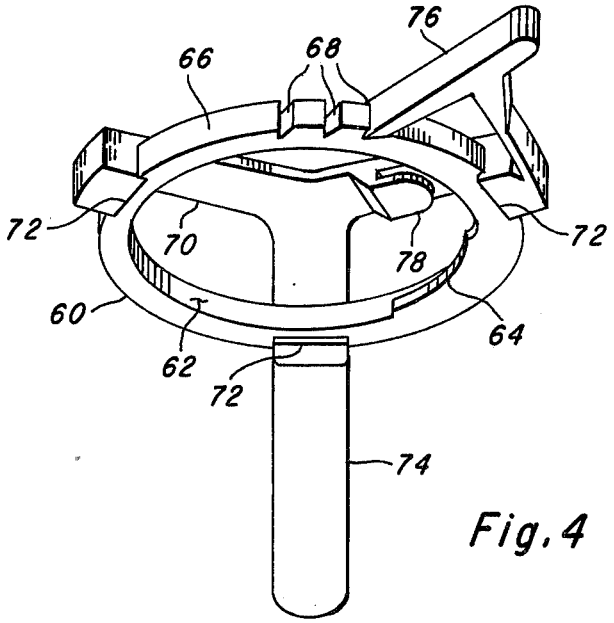
Fig. 4

CAN OPENER

This is a continuation of application Ser. No. 658,502 filed Feb. 17, 1976, now abandoned.

This invention relates to an apparatus and method for removing the tops of metallic containers and in particular to a method and apparatus for removing the top of a container having a particular bead configuration.

In recent years widespread acceptance has been accorded an aluminum container having a generally cylindrical shape and used, inter alia, in the packaging of various types of beverages. These containers are relatively inexpensive, light weight, and convenient for such use. An unfortunate aspect of these containers is an indirect result of their low cost. After initial use, a large proportion of the containers are disposed of in public places such as along roadways, in parks, and in public waterways. The negative effect of such disposal on the environment is compounded by the relative resistance of aluminum to decomposition. Such indiscriminate disposal of these containers may be substantially reduced by the discovery of beneficial secondary uses for these containers after their initial use. One such use is as a drinking glass or tumbler. Such use, however, requires that the top of the container be removed in such a way as to leave a smooth, burr free edge around the top of the container.

Most prior art can openers have been designed for use on cans which differ in an important respect from the type of can which may be opened by the apparatus of my invention. These older style cans, typically made of steel, after sealing have upper and lower surfaces which are substantially identical. At the top a sealing bead extends slightly above the plane of the upper lid. A fact of crucial importance to the present consideration is that the outer periphery of the bead of steel cans has a diameter slightly greater than that of the can body. This slightly greater bead diameter is used advantageously by one type of can opener, typified by those devices in U.S. Pat. Nos. 1,914,738, 2,138,538, 2,573,030, 2,600,615, and 2,749,612. In each of these devices a circular cutting blade is oriented in a plane slightly inclined from the vertical so as to pierce the upper lid of the can at a point just inside the bead. Support means are provided to contact the bead at its lower outside extremity. The support means, which typically takes the form of a serrated roller, provides a point of leverage for drawing the cutting blade in a generally downward direction so as to pierce the upper lid. Further means are provided for moving the support roller and cutting blade around the top of the can so to sever the lid.

One difficulty with the above described type of can opener stems from the fact that the cutting blade operates in a substantially vertical plane. Since the blade is cuttine about the inner circumference of the bead, it is extremely difficult to avoid burring the inside of the bead thus leaving a jagged edge after removal of the lid. The jagged edge is sometimes a hazard to removal of the can's contents, and precludes any subsequent use of the can as a drinking container. A more serious obstacle to the use of these prior art can openers in the present application results from the configuration of the aluminum cans themselves. In the case of the aluminum cans, the circumference of the can body itself narrows slightly at the upper end of the can and just below the location of the bead. As a result, the outer periphery of the bead has a diameter slightly smaller than that of the body of the can and the lower edge of the bead is not engagable by the support means of the prior art openers.

A second type of prior art opener is typified by the devices disclosed in U.S. Pat. Nos. 1,598,841, 1,945,137, 2,486,314, and 2,556,776. These devices are also provided with a circular cutting blade, but here the blade is arranged in a generally horizontal plane. The blade may be arranged to contact the can either inside or outside the bead and a feed or support means is provided on the opposite side of the bead so as to afford a leverage point for drawing the blade through the material of the can. A characteristic of these devices, however, is that they are designed to completely sever the bead as well as the lid of the can. These devices leave a sharp upper rim on the can and are not suitable for the present purpose.

Accordingly it will be seen that an object of the present invention is to provide a new apparatus and method for the removal of tops from metallic containers.

Another object of the invention is to provide an apparatus and method for removing the top from a metallic cylindrical container so as to leave a smooth substantially burr free rim.

A further object of the invention is to provide an apparatus and method for removing the top from an aluminum container.

Briefly, these objects are met by a structure having a relatively small circularly shaped cutting wheel or blade oriented in a substantially horizontal plane. The cutting blade is supported to contact the upper surface of the can at a point inside the bead and at the level of, or slightly below, the bottom edge of the bead. Support means are adapted to contact the outside of the bead. Finally, adjusting means are provided for controllably varying the horizontal distance between said support means and the cutting wheel.

In operation of the apparatus, the support means are placed in contact with the outside of the bead. The horizontal spacing between this support means and the cutting wheel is then adjusted so that the cutting wheel is drawn to and slightly deforms the inner top edge of the can. With the support means and cutting blade in these relative positions, the blade is drawn around the inner top edge of the can at least one complete revolution, thereby scoring the edge at the point of contact. Subsequently the horizontal spacing between the support means and the blade is reduced so that the blade penetrates more deeply into the can material and the blade is drawn once more about the inner top edge of the can. These adjusting and cutting steps are repeated until, typically after about four such iterations, the lid is completely severed from the can body. The severance is such as to leave no horizontally projecting flange on the inside of the can, and the severed edge in the can is burr free so as to render the can very suitable for use as a tumbler.

Other objects and features of the invention will be made more clear by a consideration of the following detailed description when taken in conjunction with the accompanying drawings wherein:

FIG. 3 illustrates a tip configuration for the cutting blade.

FIG. 4 is a perspective view of an alternate embodiment of the invention.

Figure 5A:
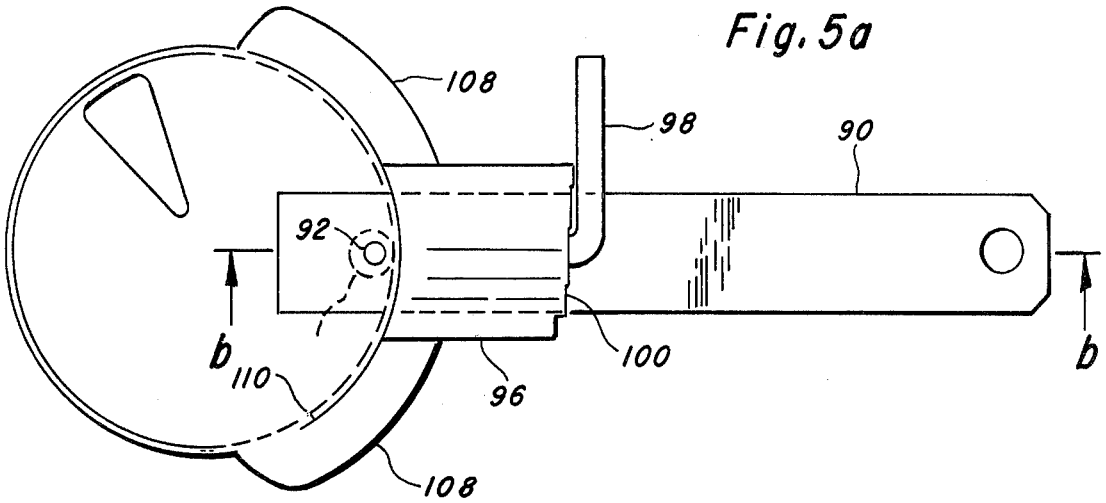

FIGS. 5*a* and *b* illustrates still another embodiment of the invention.

For convenience in understanding the following description, in the various figures, like parts will be indicated by the same reference designators. With specific reference to FIGS. 1 and 2 there is shown a plan view and a partial sectional view illustrating the preferred embodiment of the invention. The section view of FIG. 2 is taken along line AA of FIG. 1. There is shown at 10 the upper end of an aluminum can having a circumferential bead 12. It will be noted that can 10 near its upper extremity in the area 14 is slightly narrowed so that the outer wall 16 of the body of can 10 has a diameter larger than that of bead 12. Also as seen most clearly in FIG. 2, the cross section of the can lid in region 18 is almost parallel to but slightly inclined with respect to the can wall at 14.

Figure 1:
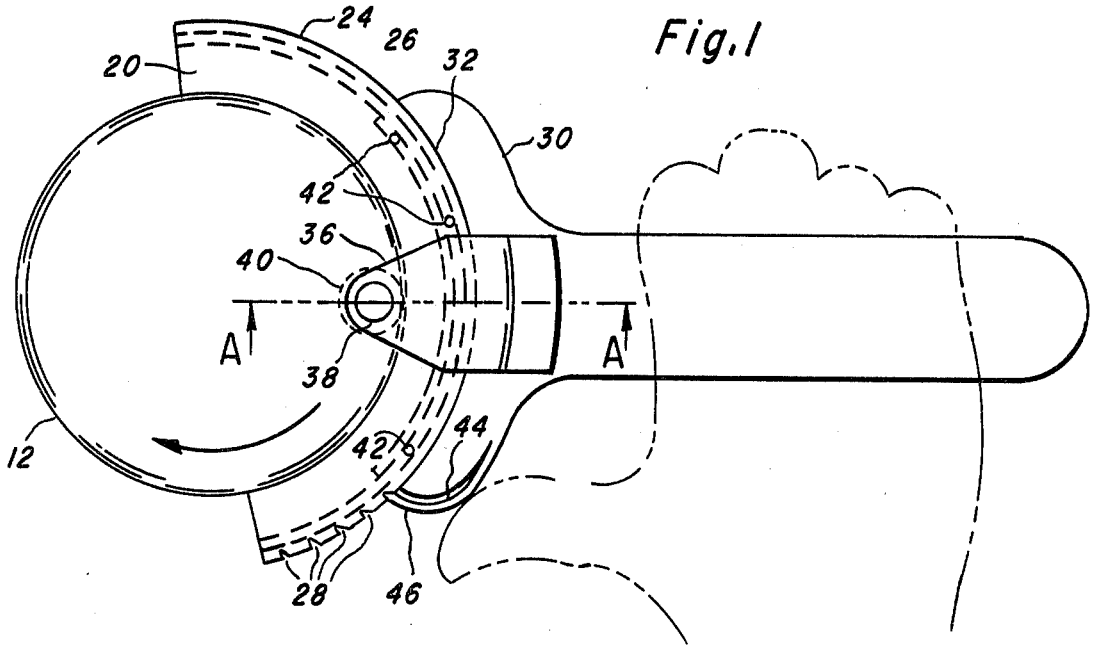
FIG. 1 is a plan view of the preferred embodiment of the invention.
Figure 2:
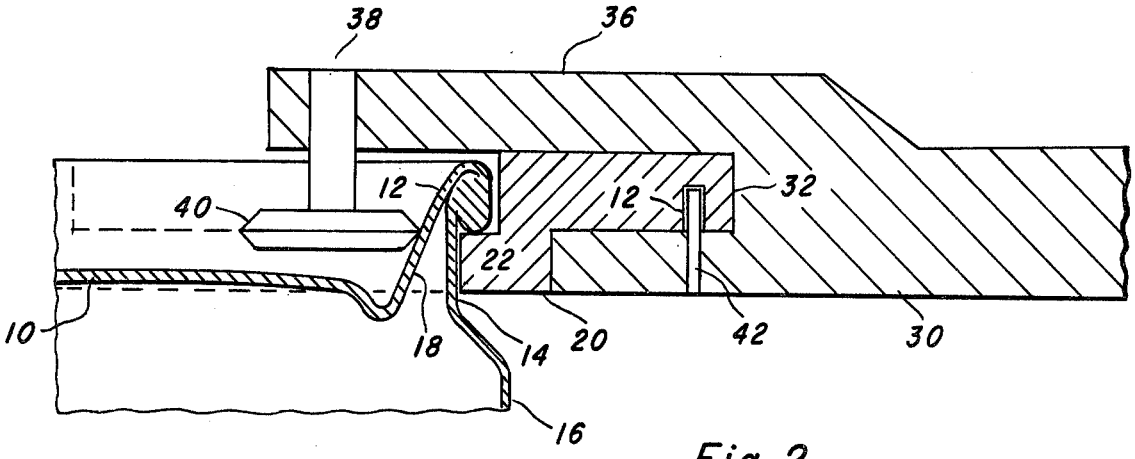
FIG. 2 is an expanded parial cross sectional view of the preferred embodiment of the invention.

Guide 20 is seen in FIG. 1 to have an approximately crescent shape. The inner wall of guide 20, adjacent bead 12, forms an arc concentric with the center of can 10 and provides a bearing surface for guide 20 against the bead of the can. This inner wall is seen in FIG. 2 to be stepped so as to have a shoulder protruding inward and under bead 12 to contact can 10 at 14. Shoulder 22 provides a bearing surface for guide 20 against the lower edge of bead 12. Outer edge 24 of guide 20 also is in the shape of an arc of a circle, but in this case the arc is slightly eccentric with respect to the center of can 10. A recess 26 is located in the bottom surface of guide 20 and forms a third arc, concentric with arc 24 but eccentric with respect to the center of can 10. Finally guide 20 is provided with a series of serrations 28 in outer edge 24.

A handle 30 has a first surface 32 having the shape of and being in sliding contact with outer edge 24 of guide 20. Handle 30 is provided with a shoulder 34 extending partially below guide 20. A support 36 is cantilevered from handle 30 so as to extend over guide 20 and over a portion of can 10. As seen in FIG. 2, the vertical spacing between the top of shoulder 22 and the bottom of support 36 is just slightly greater than the vertical dimension of bead 12. As a result, the opener structure is constrained from vertical translation with respect to the container. Stud 38 is rigidly affixed to support 36 and extends downward therefrom. A circular cutting blade 40 is rotatably attached to stud 38 by a pin or other convenient means. Alternatively, slightly differing arrangements can be used. The stud, for example, can be an integral portion of the blade and arranged to rotate freely within handle 30.

A plurality of pins 42 are fixed in shoulder 34 of handle 30 so as to extend in sliding relationship into recess 26 of guide 20. Pins 42 retain handle 30 in contact with guide 20 but permit handle 30 to rotate with respect to guide 20 about the center of curvature of edge 24. The plurality of pins 42 might alternatively be replaced by a ridge forming an integral part of handle 30 and adapted to slide in recess 26.

With handle 30 and guide 20 in the relative positions shown in FIGS. 1 and 2, cutting wheel 40 is positioned so as to just touch the upper lid of can 10 in region 18. It will be appreciated that if handle 30 is rotated in a counterclockwise direction with respect to guide 20, the eccentricity of edge 24 and recess 26 will cause cutting blade 40 to withdraw from contact with the lid of can 10. This will permit the entire structure to be withdrawn sufficiently to permit shoulder 22 to clear bead 12 thereby allowing the opener to be lifted off can 10. This is the normal relative position of handle 30 and guide 20 when placing the opener on or removing it from can 10.

With the opener located on can 10, rotation of handle 30 in the clockwise direction with respect to guide 20 will at first bring cutting blade 40 into contact with the material of the lid in region 18 as illustrated in FIGS. 1 and 2. Continued rotation beyond the position illustrated causes cutting blade 40 to slightly penetrate the material of the lid. Handle 30, which is preferably made of a relatively soft material such as plastic, is partially severed at 44 so as to leave a lock 46 extending in springing relationship from the body of handle 30. As handle 30 is rotated clockwise lock 46 encounters the first of serrations 28. The serrations 28 provide lock positions for lock 46 as handle 30 is rotated with respect to guide 20. Lock 46 is conveniently located so that the thumb of the operator may be readily used to reinforce the natural tendency of the lock to seat itself in the first of serrations 28. This first serration is positioned so that, with lock 46 located therein, cutting blade 40 slightly penetrates, but does not extend through the material of the lid.

In operating the opener, with lock 46 held in the first serration so as to maintain handle 30 and guide 20 in fixed relationship, the entire structure is drawn about the circumference of bead 12 for at least one full rotation thereby scoring the lid of can 10. While the opener is adapted to maintain the vertical position of cutting wheel 40 in a fixed relationship with respect to the top of can 10, the score further assists in maintaining this relationship during subsequent operations. After at least one full rotation of the entire structure, handle 30 is rotated further in the clockwise direction with respect to guide 20 until lock 46 engages the second of serrations 28. It will be recognized that such rotation causes cutting wheel 40 to penetrate more deeply into the material of the lid. Once again, with lock 46 held in the second serration, the entire structure is drawn about the circumference of bead 12 for at least one full rotation. This iterative procedure is continued until, with lock 46 engaged in one of serrations 28, cutting wheel 40 completely penetrates through the lid material thereby severing the lid from the can body so that it can be removed.

It will be seen in FIG. 2 that the cutting tip of cutting wheel 40 is horizontally aligned with the upper surface of shoulder 22, that is with the bottom edge of bead 12. I have discovered that the most efficient operation occurs when cutting wheel 40 is at or below this level, although the wheel may be placed above this level without departing from the spirit and scope of this invention.

Also, in a similar vein, the sharpness of the cutting tip of cutting wheel 40 may be variable. I have discovered, however, that an excessively "sharp" cutter results in burring the edge as the lid is severed. FIG. 3 shows an expanded view of the tip of a cutting wheel which I have found to be effective. The cutting edge of cutting wheel 40 is doubly beveled, with the outermost extremity of the wheel having a cross sectional angle of at least 110° as shown. The second bevel is such as to provide a cross sectional angle of 70°. If the tip of cutting wheel 40 is too sharp (having an angle less than 45°), the material 50 of the can will be burred in the areas 52.

A second embodiment of the invention is illustrated in the perspective view of FIG. 4. In this embodiment of the invention guide 60 has a generally circular shape.

Inner surface 62 is circular with a diameter just slightly larger than the diameter of the bead of a can. As such, guide 60 may readily be placed over the bead of the can, and once so located, guide 60 can be rotated with respect to the top of the can but cannot translate horizontally with respect to the can. A partial shoulder 64 is provided at the lower inside edge of guide 60. With guide 60 located around the bead of the can, shoulder 64 abuts the lower edge of the bead and prevents removal of guide 60 from the can during the cutting operation. The outer edge 66 of guide 60 is also circular in shape, but is eccentric with respect to inner edge 62. Outer edge 66 is provided with a plurality of serrations 68. A Y shaped yoke 70 is located generally above guide 60. Each arm of yoke 70 rests on the upper surface of guide 60 and includes an extension runnning downward along outer surface 66. Each such extension is terminated in a small shoulder 72 which extends slightly under guide 60. It will be seen, therefore, that yoke 70 is held affixed in sliding relationship to guide 60 so as to be rotatable with respect to the guide. One arm of yoke 70 is extended so as to provide a handle 74. A second arm of yoke 70 is provided with a relatively flexible lock 70 which is adapted to engage the serrations 68 in outer edge 66. Finally there is shown generally at 78, means for supporting a cutting wheel in a horizontal plane and in proximity to the surface to be severed when the structure is located over the lid of the can.

Operation of the device illustrated in FIG. 4 is similar to that of the preferred emodiment. Yoke 70 is guided by outer edge 66 of guide 60 as it is rotated with respect to the guide. Since, it will be recalled, outer edge 66 is eccentric with respect to the inner edge which abuts the bead of the can, it will be appreciated that rotation of yoke 70 with respect to guide 60 results in variation of the proximity of the cutting blade to the surface of the can to be severed. The first of serrations 68 is located so that when lock 76 is engaged therein, the cutting blade will just slightly penetrate the material of the can. With the lock held in this position, the entire structure is turned about the top of the can at least one full rotation. This procedure is repeated iteratively as before with lock 76 being engaged successively in adjacent serrations until the lid of the can is severed.

Figure 5B:
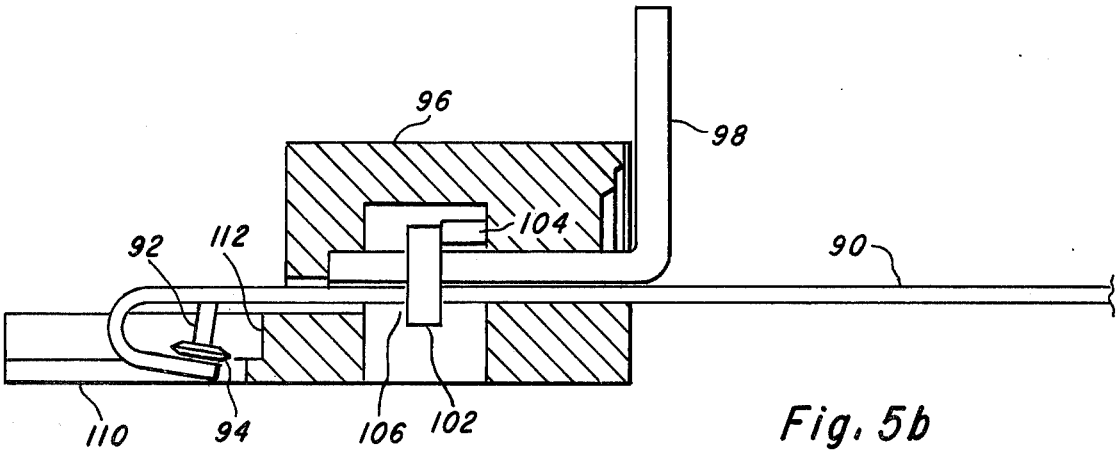

FIGS. 5*a* and 5*b* illustrate another embodiment of the invention. FIG. 5*a* is a plan view while FIG. 5*b* is a partial sectional view taken along line BB of FIG. 5*a*. A handle 90 is configured at one end thereof to support a shaft 92 on which is rotatably mounted a cutting blade 94. Handle 90 is partially enclosed within adjustable housing 96. A lever 98, comprised of a length of stock having a circular cross section and including a 90° bend, is located within and in sliding and rotating relationship with respect to housing 96. Housing 96 in region 100 is provided with a plurality of steps radiating from a point approximately at the center of rotation of lever 98. Lever 98 has as an integral portion thereof a shoulder 102 with a circular cross section and a diameter substantially greater than that of the lever. As lever 98 is rotated so as to move from one to another of the steps in housing 96 the lever and its shoulder 102 are caused to translate longitudinally with respect to the body of housing 96. Housing 96 has an interior recess to permit translation of shoulder 102. A spring member 104 bears against one wall of the recess and against shoulder 102 so as to maintain lever 98 at all times in tension against the steps of housing 96. Handle 90 is provided with a transverse slot 106 to accomodate the lower projection of shoulder 102. Thus it will be seen that as lever 98 is rotated so as to traverse one or more of the steps, shoulder 102 translates with respect to housing 96 but maintains a constant longitudinal relationship with respect to handle 90. The result is longitudinal translation of housing 96 with respect to handle 90.

Housing 96 is provided with arcuate extensions 108. Each of extensions 108 includes a shoulder 110 extending around its lower inner periphery. Extensions 108 are adapted to bear against the bead of a container while shoulders 110 provide a reference against the bottom of the bead. It will be seen from the foregoing that, as lever 98 is rotated so as to move from one to another of the steps in housing 96, handle 90 and cutting blade 94 will be caused to translate and the distance between the cutting blade 94 and point 112 on housing 96 will vary.

Operationally, lever 98 is first rotated as far as possible counter-clockwise when viewed from the handle end of the opener. This has the effect of maximizing the distance between cutting blade 94 and point 112 on housing 96. With the apparatus so adjusted the opener may readily be placed over the top of a container with shoulders 110 located against the bottom of the bead. Subsequent rotation of lever 98 causes cutting blade 94 to approach and slightly penetrate the material of the lid of the container. With the opener so adjusted it is drawn around the circumference of the container at least one full revolution. Lever 98 is then further rotated in the clockwise direction so as to cause cutting blade 94 to penetrate more deeply into the lid of the container. The opener is again rotated about the top of the container at least one full revolution. These steps of adjusting the opener and then rotating it about the top of the container are repeated iteratively until the lid of the container is severed.

There have been disclosed several embodiments of a novel can opener. There may be suggested to those skilled in the art certain minor modifications which do not depart from the spirit and scope of the invention as set forth in the appended claims.

What is claimed is:

1. Apparatus for removing the lid of a cylindrical metal container of circular cross section, comprising in combination:

(a) a guide for slidingly engaging the outer surface of said container, (b) a support having means for engaging a portion of said guide in sliding relationship thereto, at least one of said means for engaging and said portion of said guide conforming to an arc of a circle, (c) a circular cutting blade carried by said support in a plane substantially conforming to the plane of said arc of a circle, (d) said guide and said support cooperating so that movement of said support relative to said guide results in variation of the depth of penetration of said cutting blade into the material of said lid, and (e) means for selectably establishing at least two discrete positions of said support relative to said guide and for establishing at least two discrete depths of penetration of said cutting blade into the material of said lid.

2. The apparatus of claim 1 wherein said guide includes an arcuate surface for engaging the outer wall of said container.

3. The apparatus of claim 1 wherein said means for establishing comprises a plurality of serrations in one of said guide and said support and a lock on the other of said guide and said support for selectably engaging one of said serrations.

4. The apparatus of claim 1 wherein said arc of a circle is eccentric relative to the circular cross section of said container when the apparatus is in operating position on said container.

5. Apparatus for removing the lid of a cylindrical metal container of circular cross section, comprising in combination:

(a) a guide for slidingly engaging the outer surface of said container, (b) a support having means for engaging a portion of said guide in sliding relationship thereto, (c) a circular cutting blade carried by said support in a substantially horizontal plane when said apparatus is in operating position on an upright conatiner, and (d) a rotatable member coupling said support to said guide and operative to withdraw said blade toward the point of engagement of said guide and can thereby causing said blade to penetrate the material of said lid, (e) said rotatable member having at least two discrete operating positions with corresponding depths of penetration of said blade into the material of said lid.

6. The apparatus of claim 5 wherein said guide includes an arcuate surface for engaging the outer wall of said container.

7. The apparatus of claim 5 wherein said rotatable member is in sliding and rotating relationship to said guide and wherein said rotatable member includes a shoulder for engaging a slot in said support.

* * * * *